US005472460A

United States Patent [19]

Schmierer

[11] Patent Number: 5,472,460

[45] Date of Patent: Dec. 5, 1995

[54] FILTER BAG FOR VACUUM CLEANERS

[75] Inventor: Uwe Schmierer, Dietenhofen, Germany

[73] Assignee: Branofilter GmbH, Dietenhofen, Germany

[21] Appl. No.: 337,780

[22] Filed: Nov. 14, 1994

[30] Foreign Application Priority Data

Nov. 18, 1993 [DE] Germany ..... 43 39 298.9

[51] Int. Cl.[6] ..... B01D 46/00

[52] U.S. Cl. ..... 55/367; 15/347; 55/377; 55/DIG. 2

[58] Field of Search ..... 15/347; 55/361, 55/367, 373, 376, 377, 378, DIG. 2

[56] References Cited

U.S. PATENT DOCUMENTS

| | | | |
|---|---|---|---|
| 2,758,667 | 8/1956 | Brace | 55/367 |
| 2,864,462 | 12/1958 | Brace | 55/367 |
| 3,483,679 | 12/1969 | Balbierer | 55/367 |
| 3,675,399 | 7/1972 | Westergren | 55/367 |
| 4,738,697 | 4/1988 | Westergren | 55/376 |
| 5,158,635 | 10/1992 | Schmierer et al. | 156/367 |

FOREIGN PATENT DOCUMENTS 0362624 6/1993 European Pat. Off. .

*Primary Examiner*—C. Scott Bushey
*Attorney, Agent, or Firm*—Flynn, Thiel, Boutell & Tanis

[57] ABSTRACT

A vacuum cleaner filter bag has a connection member with an essentially tabular, board-like, stiff main body, which has a fitting opening for fitting on a vacuum cleaner connector tube. The main body guides a closing slide with a passage opening, which by way of a handle part is able to be moved out from an open position clearing the fitting opening into the closed position. The main body is divided into a holding ring surrounding the fitting opening on the outer side of the connection member and a closing slide guide: part constituted by the rest of the main body, the holding ring and the closing slide guide part being connected together at an attachment joint while being otherwise separate or separable from each other. In the position of use, with the connection member seated on the connector tube, the closing slide guide part is able to be pivoted away from the connector tube so that the closing slide comes clear of the connector tube and is able to be drawn into its closed setting.

17 Claims, 3 Drawing Sheets

FILTER BAG FOR VACUUM CLEANERS

BACKGROUND OF THE INVENTION

The invention relates to a filter bag for vacuum cleaners, having a connection member, which comprises an essentially tabular main body of board-like stiff material and a closing slide guided thereby the main body possessing a fitting opening for fitting the connection member onto a connector tube of the vacuum cleaner and the closing slide has a passage opening, said closing slide being adapted to be drawn out of an open position, in which the passage opening clears the fitting opening into a closed position closing the fitting opening by means of a handle part exposed on the front transverse edge part of the main body.

Such a filter bag, disclosed for example in the German patent publication 4,002,868 C, may, when it is removed in the filled state from the vacuum cleaner, being closed by means of the closing slide so that no dust may escape into the surroundings.

In the case of the filter bag in accordance with the said the German patent publication 4,002,868 C it is necessary, before drawing the closing slide into its closed position, for the connection member to be pulled off the connector tube and for the filter bag to be removed from the vacuum cleaner. It is in this manner that a substantial amount of dust may escape into the surroundings, more especially when if, as is frequently the case, the bag is pressed against the wall of the vacuum cleaner, this being something which will cause dust to be blown out from the bag.

The European patent publication 0 362 624 relating to a filter bag similar to that in accordance with the German patent publication 4,002,868 C on the contrary proposes a design wherein the handle part of the closing slide is gripped and drawn while the connection member is still held on the vacuum cleaner. Since however direct closing of the fitting opening in the main body is hindered by the connector tube of the vacuum cleaner still projecting the fitting opening, such a firm pull is required that the main body together with the closing slide is caused to bulge out as far as a point short of the connector tube. It is then uncertain whether the closing slide will then close immediately. Owing to the strain on the connection member with the bulging effect and owing to the frictional forces it is in fact likely that on pulling on the handle part the connection member as a whole will slip out of the vacuum cleaner before the closing slide moves in relation to the main body.

SHORT SUMMARY OF THE INVENTION

One object of the invention is accordingly to provide a filter bag of the type initially mentioned, which ensures reliable closing before it is removed from the vacuum cleaner.

In accordance with the invention this object is to be achieved by the feature that the main body is divided into a holding ring surrounding the fitting opening on the outer side, facing the filter bag, of the connection member, and into a guide part of the closing slide for guiding the closing slide and constituted by the rest of the main body, the holding ring and the closing slide guide part being connected together at an attachment join part, which is remote from the handle part of the closing slide, but are otherwise are separate from each other or able to be separated from each other so that in the position of use when the connection member is slipped over the connector tube on the vacuum cleaner, the closing slide guide part is able to be pivoted adjacent to the attachment join part in relation to the holding ring remaining on the connector tube away from the connector tube so that the closing slide comes clear of the connector tube and may be drawn into its closed position.

In the case of the connection member in accordance with the invention it is therefore possible to so proceed that simultaneously with gripping the handle part the closing slide guide part of the main body is pivoted away from the connector tube while the holding ring remains on the connector tube, after which the closing slide is able to be closed immediately in front of the connector tube. During such closing the main body is held against the connector tube using the holding ring so that the main body may not be moved with the closing slide when pulling it. It is only at the end, when the closing slide is moved into its closed position that the holding ring is stripped off the connector tube so that the filter bag may then be removed from the vacuum cleaner.

Further advantageous developments and convenient forms of the invention will be understood from the following detailed descriptive disclosure of one embodiment thereof in conjunction with the accompanying drawings.

DETAILED ACCOUNT OF WORKING EMBODIMENT OF THE INVENTION

Figure 1:
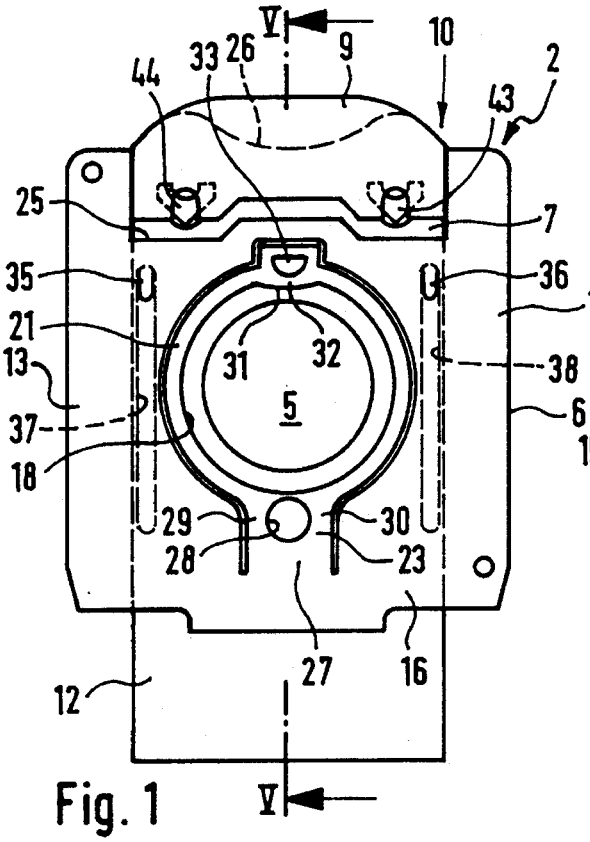
FIG. 1 shows a connection member in accordance with the invention separately and in plan view looking toward the outer side facing away from the filter bag as such, with which the connection member, which is to the front, is fitted on the connector tube of the vacuum cleaner, the closing slide being in its open position.

The filter bag explained in what follows comprises the filter bag 1 as such, whose wall is manufactured of a material permeable to air and holds back dust, and a connection member 2, which is attached to a portion of the filter bag 1 as such having the inlet opening, preferably by bonding.

On one wall 3 of the vacuum cleaner, for which the filter bag is designed, there is a connector tube 4 extending into the accommodating space for the filter bag, over which the connection member 2 is slipped on placing the filter bag in the vacuum cleaner so that the connector tube 4 fits through a fitting opening 5 formed on the connection member 2 and extends into the interior of the filter bag. It is in this manner that the air drawn in by the vacuum cleaner gets into the filter bag, in which then the dust filtered by the filter wall remains.

The connection member 2 comprises an essentially tabular or plate-like main body 6 of board-like, stiff material, which possesses the fitting opening for the connector tube 4, and a closing slide 7 running in the main body 6. The closing slide 7 comprises a passage opening 8, which in the initial position of the closing slide 7 is aligned with the fitting opening 5 of the main body 6 so that the passage opening 8 does not hinder slipping the connection member 2 onto the connector tube 4 and the air may flow without being hindered into the filter bag. This initial position constitutes the open position of the closing slide 7.

Figure 2:
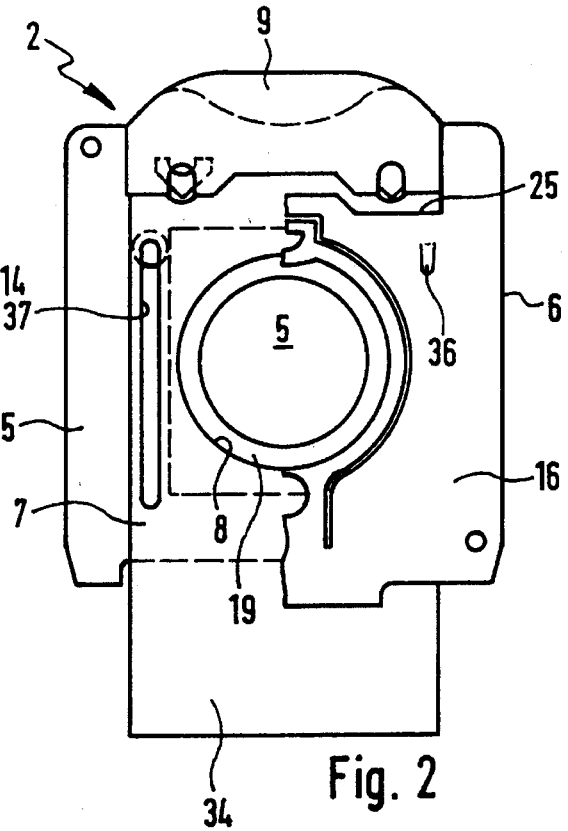
FIG. 2 shows the arrangement of FIG. 1 with the difference that the left half of the outer ply facing the reader, of the main body is shown cut away.
Figure 3:
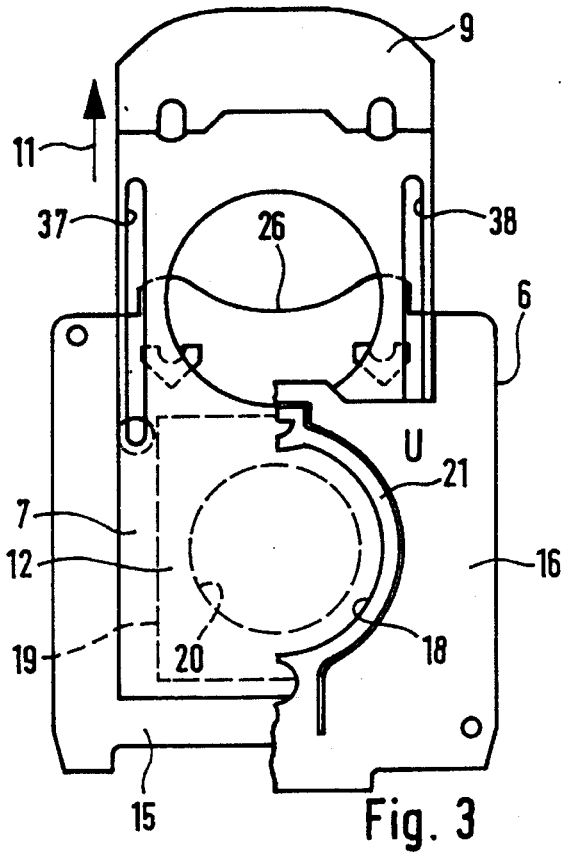
FIG. 3 shows the same connecting member in the manner of representation of FIG. 2, the closing slide being drawn into the closed position.
Figure 4:
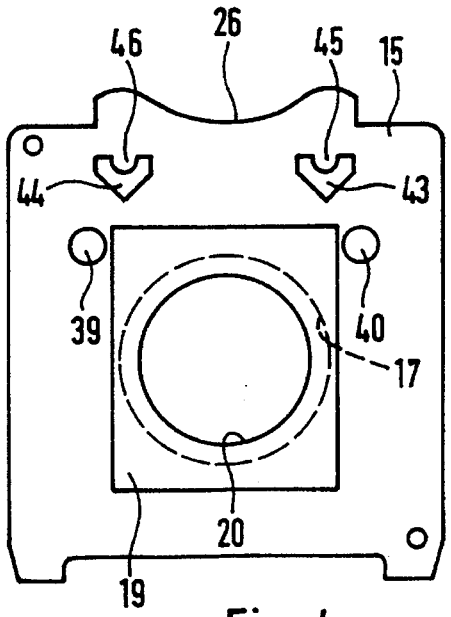
FIG. 4 is a view corresponding to FIGS. 1 through 3, in the case of which the outer plies and the closing slide are omitted so that the inner ply is visible with the diaphragm seal attached to it.

The closing slide 7 has handle part 9, which is exposed at the front transverse part 10 of the main body 6 so that 1 can be gripped by the hand By drawing the handle part 9 forward and away from the main body 6 (arrow 11) the closing slide 7 may be shifted from its open position (FIG. 2) closing the fitting opening 5 into a closed position (FIG. 3) closing the fitting opening. For this purpose the closing slide 7 possesses behind the passage opening 8 (as seen from the handle part 9) a non-perforate portion 12 extending as far as the end of the closing slide opposite to the handle part 9, such portion closing the fitting opening 5 in the closed position. The direction of movement of the closing slide 7 extends parallel to its two lateral edge parts 13 and 14.

In the present, preferred embodiment of the invention the main body 6 possesses a substantially twin ply structure so that one inner ply 15 facing the filter bag 1 as such and an outer ply 16 seated thereon are present. Between two plies 15 and 16, which will generally consist of a board material, there is the closing slide 7. In this respect the two plies 15 and 16 of the main body 6 are permanently bonded together on either side of the closing slide 7 at the lateral edge parts 13 and 14, such bonding generally being produced by using an adhesive. Between the two bonded parts so produced extending in the longitudinal direction of the main body 6 the closing slide 7 thus extends through the main body 6 so that the two bonded parts constitute lateral guides for the closing slide 7.

Figure 5:
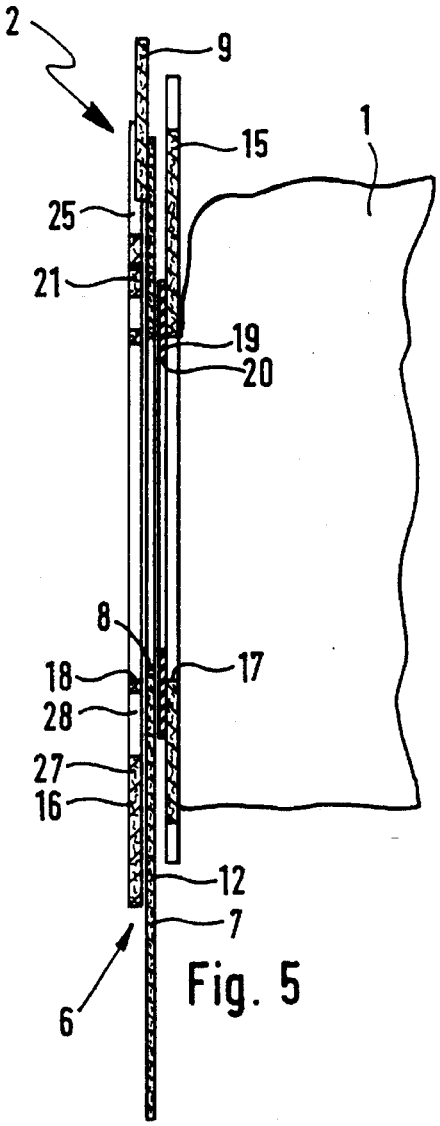
FIG. 5 shows the same connection member in a longitudinal section taken on the line V—V of FIG. 1 on a larger scale, the individual plies being shown spaced apart than in reality and furthermore the filter bag as such being illustrated.
Figure 8:
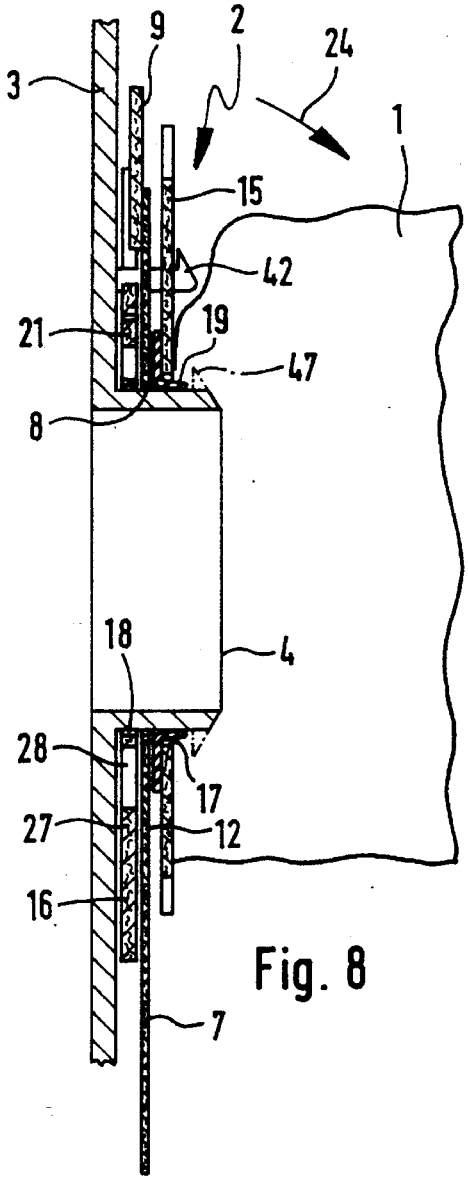
FIG. 8 shows the connection member in the same sectional representation as in FIG. 5, the connection member and, respectively, and the filter bag being in the position of use, in which it is held against the wall of the vacuum cleaner and the connector tube is inserted into the fitting opening.
Figure 6:
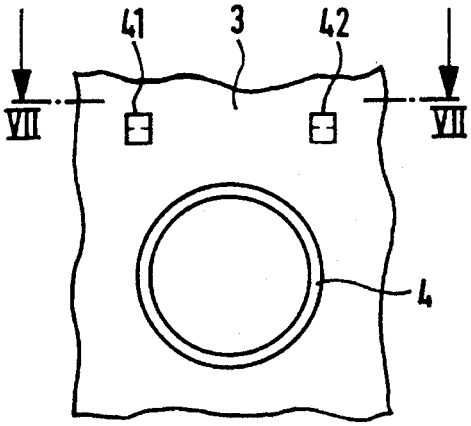
FIG. 6 shows the wall, having the connector tube, of the vacuum cleaner in a plan view as seen from the accommodating space of the vacuum cleaner (arrow VI in FIG. 7).
Figure 7:
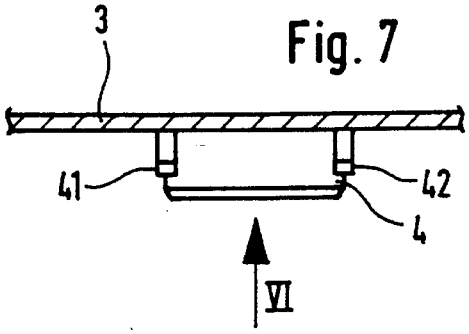
FIG. 7 shows the arrangement in accordance with FIG. 6 in a section at a right angle adjacent to section of such figure in accordance dance with the section line VII—VII.
Figure 9:
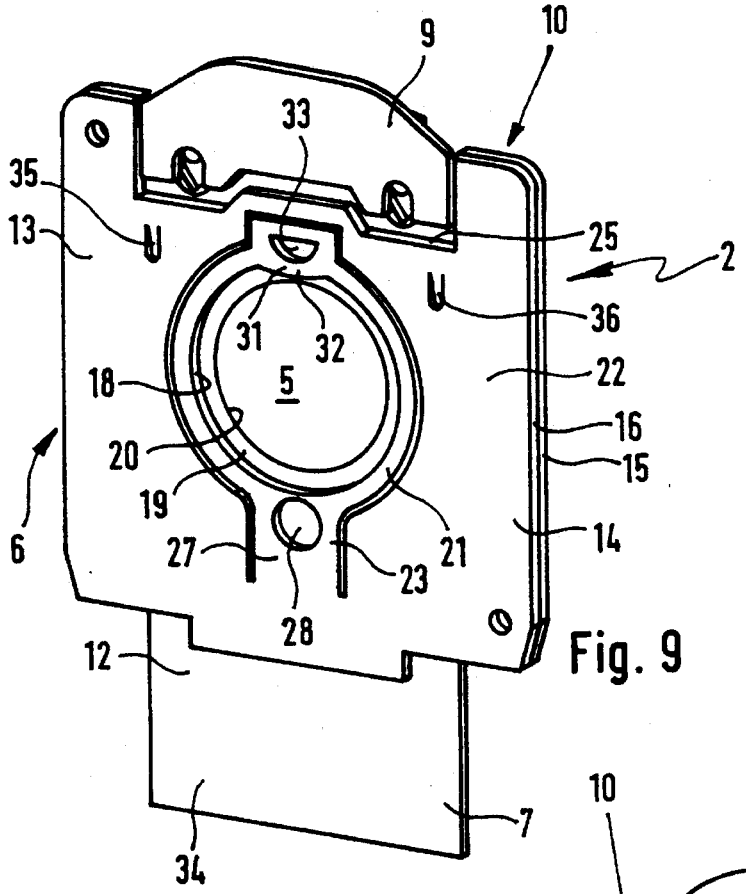
FIG. 9 shows the same connection member in an oblique view, the outer side, as in FIG. 1, being turned toward the reader.

As already indicated, in FIGS. 5 and 8 the two plies 15 and 16 have been drawn so as to be somewhat spaced apart, (whereas in reality this is not so) in order to provide a better representation of the connection member.

The two plies 15 and 16 of the main body 6 respectively have a hole 17 and, respectively, 18 at the position of the fitting opening 5, such two holes 17 and 18 together producing the fitting opening 5.

In the illustrated working embodiment of the invention the main body 10 furthermore has a perforated diaphragm seal 19, which is arranged between the inner ply 15 and the closing slide 15 and more particularly is so secured by adhesive that the diaphragm hole 20 therein is aligned with the holes 17 and 18 responsible for forming the fitting opening 5, in the two plies 15 and 16. In this respect the diameter of the diaphragm hole 20 is smaller than the diameter of the holes 17 and 18 or, respectively, of the fitting opening 5 with the result that the diaphragm seal 19 is splayed out in an annular manner on slipping the connection member 2 on the connector tube 4 and comes into sealing engagement with the connector tube.

Figure 10:
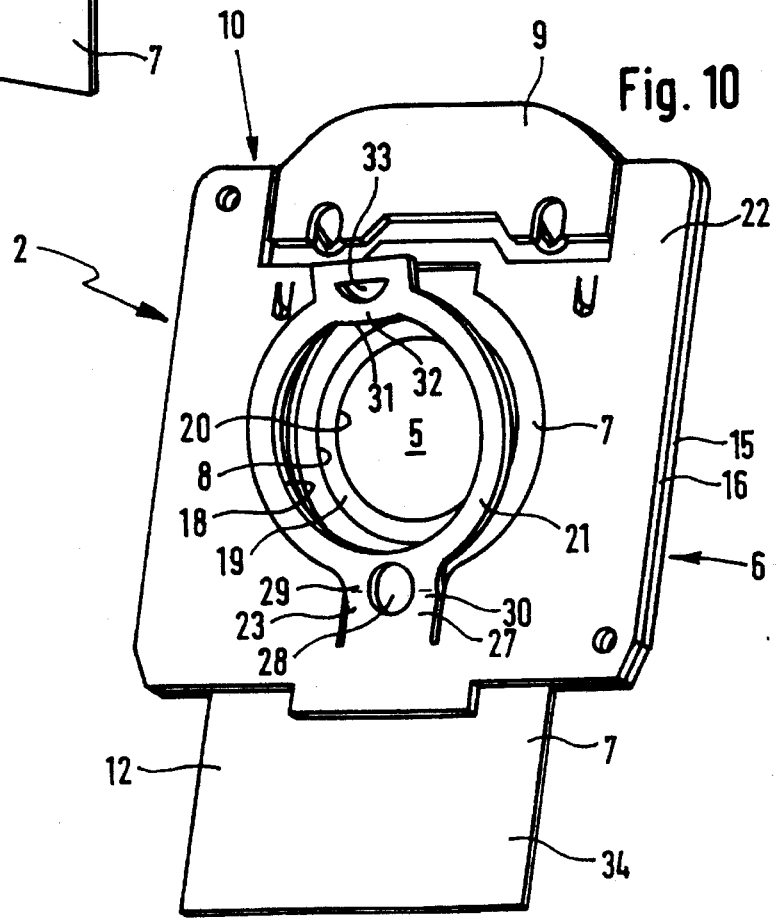
FIG. 10 shows am oblique view corresponding to FIG. 9 of the same connection member, in which case however the closing slide guide part of the main body is pivoted away from the holding ring (the vacuum cleaner wall with the connector tube is omitted in order to render the drawing more straightforward).

When the filter bag is full of dust, it is removed from the vacuum cleaner. In this respect the closing slide 7 is to be moved as rapidly as possible into its closed position to prevent the escape of dust into the surroundings. Immediate or direct closing of the closing slide while the connection member 2 is still on the connector tube is however not possible, since the connector tube 4 also extends through the passage opening 8 in the closing slide 7 and hence keeps the closing slide in place and in its open setting. In this connection there is the provision in accordance with the invention that the main body 6 is divided into a holding ring 21 surrounding the fitting opening 5 on the outer side, facing away from the filter bag 1 of the connection member 2 and a closing slide guide part 22 for guidance of the closing slide 7 and constituted by the rest of the main body, the holding ring 21 and the closing slide guide part 22 being permanently joined together at an attachment joint 23, which is remote from the handle part 9 of the closing slide 7, but elsewhere are separate or able to be separated from one another. It is in this manner that in the position of use, when the connection member 2 is slipped onto the connector tube 4 it is possible for the closing slide guide part 22 to be pivoted adjacent to the attachment joint 23 in relation to the holding ring 21 remaining on the connector tube 4 and away from the same so that the closing slide 7 comes clear of the connector tube 4 and may be pulled into its closed position. Thus while in this embodiment the holding ring 21 is separated or severed from the main body (with the exception of the attachment joint 23) by a cut and remains on the connector tube 4, the closing slide guide part 22 together with the closing slide 7, may be pulled away from the holding ring 21 and therefore from the connector tube 4 so that the closing slide guide part 22 is located in front of the end of the connector tube. The connector tube is then no longer in the way of moving the closing slide into the closed position. This pivoting is indicated in FIG. 10. In FIG. 8 the pivoting takes place in the direction as indicated by the arrow 24. The pivotal movement takes place at the attachment joint 23. It is naturally here not a question of an exactly set, completely regular, pivot axis but rather of a pivotal bending movement.

To perform this pivotal movement of the closing slide guide part 22 the front transverse edge part 10 of the main body 6 is gripped, on which the handle part 9 is located. Once the closing slide guide part 22 has been sufficiently moved away from the wall 3 of the vacuum cleaner it is possible to shift the closing slide 7, as already mentioned, into its closed setting. A more rapid closing of the filter bag would be hard to think of. When the handle part 9 is drawn the connector tube 4 retains the main body 6 in place by means of the holding ring 21 mounted on it. After this the filter bag is then removed from the vacuum cleaner, for which purpose it is merely necessary to pull the holding ring 21 away from the connector tube 4.

The handle part 9 of the closing slide 7 is freely exposed on the outer side of the connector tube 2, since in the embodiment of the invention the outer ply 16 of the main body 6 at this position has a suitable cutout 25. In this respect the handle part 9 rests at least in part on the inner ply 15 of the main body 6 adjacent to the filter bag 1 as such so that on pressing against the handle part 9 from the outside the inner ply 15 and accordingly the entire closing slide guide part 22 of the main body is entrained and pivoted. The inner ply 15 may be so designed at its front end that the handle part 9 is here as well sufficiently exposed in order to be able to be directly gripped. This configuration 26 of the front end of the inner ply 15 is more especially to be seen in FIGS. 1 through 4.

The attachment joint 23, at which the holding ring 21 merges and is joined with the closing slide guide part 22, is, as shown in the figures, preferably arranged on the side, which is opposite to the handle part 9, of the closing slide 7, of the fitting opening 5 and is therefore as seen from the handle 9 direction behind the fitting opening 5. In principle it would be feasible for the attachment joint to be located elsewhere about the holding ring. The illustrated design is however more advantageous as regards the pivotal action and closing.

The holding ring can be constituted by a separate part. The holding ring 21 and the closing slide guide part 22 are however preferably manufactured integrally, as in the embodiment of the invention, because the holding ring 21 is formed by the outer ply 16 remote from the filter bag 1.

The hole 18, which, as it were, constitutes the external half of the fitting opening 5, is formed by the holding ring 21.

The holding ring 21 is connected at the attachment joint 23 by means of a connecting strip 27, which extends outward radially and from it, with the closing slide guide part 22.

To facilitate bending of the material of the main body at the attachment joint 23 during pivotal movement of the closing slide guide part 22 and to limit the range in which hinging takes place, it is possible for the holding ring 21 and the closing slide guide part 22 to be connected together at the attachment joint 23 using two connecting ribs 29 and 30 separated from one another by a weakening recess 28. It is naturally possible to provide a plurality of weakening recesses for a division up into more than two connecting ribs.

The holding ring 21 should hold the connector tube 4 as well as possible so that on pivoting of the closing slide guide part 22 and following closing of the slide it does not accidently slip off the connector tube. For this purpose it would be in principle possible to make the hole 18 contained in the holding ring 21 a little smaller all the way round than the external cross section of the connector tube 4 so that the holding ring 21 would be seated with a clamping action on the connector tube. In the preferred embodiment of the invention on the contrary the holding ring 21 has a radially inwardly directed clamping projection 31 on its inner periphery. It would be also possible to provide a plurality of such clamping projections placed around the periphery. The clamping projection 31 constitutes in effect a point of constriction, at which the diameter of the hole 18 is smaller than the external diameter of the connector tube 4. Otherwise it is possible for the holding ring 21 to be slipped with play on the connector tube 4.

As shown in figures, the clamping projection 31 is arranged on the side of the holding ring 21 facing the handle part 9 of the closing slide 7, though in principle it could be arranged at some other point.

As regards details the clamping projection 31 illustrated possesses an outline similar to a secant, and the clamping projection as illustrated has a rounded outline, that is to say, it is slightly crowned it where it fits into the hole 18.

The clamping effect caused holds the holding ring 21 on the connector tube. It will be clear that the clamping force may not be so great that it excessively impedes pulling off the holding ring from the connector tube and after the transfer of the closing slide into the closed position unnecessary.

The clamping projection 31 may, as illustrated, be constituted by a clamping rib 32 which is narrower than the rest of the clamping ring, such clamping ring being delimited by a clamping recess 33 formed in the clamping ring. Such a clamping rib 32 may be more readily deformed on slipping connection member onto the connector tube.

The closing slide 7 is preferably constituted by a thin, flexible strip of material.

Such a strip of material may not only be readily pulled out, but furthermore involves the advantage in the case of a closing slide, whose rear end part 34 extends to the rear out of the main body 6, that the closing slide end part 34 projecting adjacent to rear, practically takes up no space in the vacuum cleaner, since it is may be folded up or packed together.

In its closed setting (FIG. 3) on the main body 6 the closing slide 7 is prevented from slipping out further. This ensures not only that the closing slide 7 is not pulled out past the fitting opening 5 completely, but furthermore facilitates handling when removing the filter bag from the vacuum cleaner. It is then in fact only necessary, when the closing slide guide part 22 has been moved into the pivotal setting indicated in FIG. 10, to pull on the handle part 9 of the closing slide 7 so that the closing slide 7 is firstly transferred into the closed position thereof and by further suitable oblique pulling thereon the holding ring 21 may also be taken off the connector tube 4. The entire removal of the bag may consequently be performed with one simple movement of the hand.

In this connection it is significant that the handle part 9 is made stiffer than the film-like flexible strip of the closing slide 7. In the present embodiment of the invention the handle part 9 is, like the plies 15 and 16, constituted by a piece of board, which is bonded to the flexible strip.

In order for the closing slide 7 to be retained in the closed setting thereof to prevent its being pulled further outward, in the embodiment of the invention there is the provision that the closing slide 7 runs up against a delimiting abutment arranged on the main body 6 on movement into the closed position. This delimiting abutment may be designed in various different ways. In the illustrated design it is a question of two abutment leaves 35 and 36 cut from the external ply 16 and connected integrally with the same, which are bent out from the plane of the external ply 16 through respectively one longitudinal slot 37 and, respectively, 38 to the internal ply 15 and there fit into a recess 39 and, respectively, 40 of suitable size, where the abutment leaves 35 and 36 may be bonded in place. The abutment leaves 35 and 36 consequently respectively extend through a longitudinal slot 37 and respectively 38 extending in the direction of motion of the closing slide and in the slide itself and are at such a point that in the closed setting the rear slot end runs up against the respective abutment leaf.

In the position of use the connection member 2 and accordingly the closing slide guide part 22 should not be able to pivot away from the holding ring 21 accidently and the same is secured to the wall 3 of the vacuum cleaner. For this purpose at least one detent projection 41 and 42 can be provided on the vacuum cleaner, with which an aperture 43 and, respectively, 44 is associated on the main body 6 clear of the holding ring 21 for the passage of the respective detent projection. Simultaneously with the placement of the connection member 2 on the connector tube the detent projections 41 and 42 come to extend through the apertures 43 and 44 and fit behind the connection member as indicated in FIG. 8. This locking action is overcome on removal of the filter bag by exerting a suitably increased force on pivoting the closing slide guide part 22 away from the connector tube 4. This separation is facilitated because adjacent to the recess 25 in the external ply 16 the detent projections 41 and 42 merely extend through the closing slide 7, to which the handle part 9 belongs as well, at the apertures 43 and 44 the internal ply constituting respectively a detent stub 45 and, respectively, 46, behind which the respective detent projection fits, such detent stub moving out of the way for the closing slide guide part 22 and coming out of engagement with the detent projection 41 and, respectively, 42.

Instead of the use of the detent projections 41 and 42 and of the apertures 43 and 44 the connection member 2 could be held in the position of use if the connector tube 4 were to have a radially projecting, hooked annular projection 47 (marked in FIG. 8 in chained lines), past which the connection member 2 is thrust into its position of use. Such an annular projection 47 also fits behind the connector tube in the position of use, the dimensions having to be so selected that the later removal of the connection member from the connector tube is not hindered.

I claim:

1. A filter bag for vacuum cleaners, having a connection member, which comprises an essentially tabular main body of stiff board material and a closing slide guided thereby, the main body possessing a fitting opening for fitting the connection member onto a connector tube of the vacuum cleaner and the closing slide has a passage opening, said closing slide being adapted to be drawn out of an open position, in which the passage opening clears the fitting opening into a closed position closing the fitting opening by means of a handle part, exposed on the front transverse edge part of the main body, wherein the main body is divided into a holding ring surrounding the fitting opening on the outer side, opposite the filter bag, of the connection member, and into a guide part of the closing slide for guiding the closing slide and constituted by the rest of the main body, the holding ring and the closing slide guide part being connected together at an attachment joint part, which is remote from the handle part of the closing slide, but are otherwise separate from each other or able to be separated from each other so that in the position of use when the connection member is slipped over the connector tube on the vacuum cleaner, the closing slide guide part is able to be pivoted adjacent to the attachment joint part in relation to the holding ring remaining on the connector tube away from the connector tube so that the closing slide comes clear of the connector tube and may be drawn into its closed position.

2. The filter bag as set forth in claim 1, wherein the attachment joint is arranged on the side of the fitting opening which is opposite to the handle part of the closing slide.

3. The filter bag as set forth in claim 1, wherein the holding ring and the closing slide guide part of the main body are manufactured integrally with one another.

4. The filter bag as set forth in claim 3, wherein the closing slide is arranged between two plies of the main body and the holding ring is formed by the external ply remote from the filter bag.

5. The filter bag as set forth in claim 1, wherein at the attachment joint the holding ring is connected by means of a connecting leaf, directed away from it with the closing slide guide part.

6. The filter bag as set forth in claim 1, wherein the holding ring and the closing slide guide part at the attachment joint are connected with each other by means of at least two connecting ribs separated from each other by a recess for weakening the structure.

7. The filter bag as set forth in claim 1, wherein at an inner periphery thereof the holding ring possesses at least one clamping projection extending radially inward for clamping engagement of the holding ring on the connector tube.

8. The filter bag as set forth in claim 7, wherein the clamping projection is arranged at the side, which faces the handle part of the closing slide.

9. The filter bag as set forth in claim 7, wherein the clamping projection possesses an outline similar to that of a secant.

10. The filter bag as set forth in claim 7, wherein the clamping projection has a rounded outline.

11. The filter bag as set forth in claim 7, wherein the clamping projection is constituted by a rib, which is narrower than the rest of the width of the holding ring, such clamping rib being delimited by a clamping recess formed in the holding ring.

12. The filter bag as set forth in claim 1, wherein the handle part of the closing slide is at least partially rested on a ply, adjacent the filter bag.

13. The filter bag as set forth in claim 1, wherein the closing slide is constituted by a thin flexible strip of film material, the handle part comprising stiffer material.

14. The filter bag as set forth in claim 1, wherein a rear end part of the closing slide projects at the rear out from the holding ring.

15. The filter bag as set forth in claim 1, wherein the closing slide is secured in the closed position of the main body against being pulled out farther.

16. The filter bag as set forth in claim 15, wherein the closing slide is secured in the closed position against a limiting abutment arranged on the main body.

17. The filter bag as set forth in claim 1, wherein the main body possesses at least one aperture, arranged beyond the periphery of the holding ring, for the extension therethrough of a detent projection on the vacuum cleaner in the position of use, the detent action being able to be overridden by exerting a suitably increased force on pivoting the closing slide guide part.

* * * * *